US005172815A

United States Patent [19]

Schock et al.

[11] Patent Number: 5,172,815

[45] Date of Patent: Dec. 22, 1992

[54] GRAVITY FEED JEWELRY DISPLAY SYSTEM AND DUAL-FLANGE DISPLAY CARD

[75] Inventors: Richard J. Schock, Sherman Oaks, Calif.; Fred Richmond, New York, N.Y.; Jeffrey A. Feibelman, East Greenwich, R.I.

[73] Assignees: Mel Bernie & Company, Inc., Burbank, Calif.; Display Technologies, Inc., Johnston, R.I.

[21] Appl. No.: 522,520

[22] Filed: May 11, 1990

[51] Int. Cl.[5] ..... A47F 7/00

[52] U.S. Cl. ..... 211/13; 206/566; 211/59.2; 211/163

[58] Field of Search ..... 211/13, 59.2, 163, 56; 312/42, 50, 59; 206/566, 6.1

[56] References Cited

U.S. PATENT DOCUMENTS

| | | | |
|---|---|---|---|
| 1,931,403 | 10/1933 | Connor | 312/42 |
| 3,210,140 | 10/1965 | Smythe | 211/59.2 X |
| 3,243,047 | 3/1966 | Witteborg | 211/163 X |
| 3,858,757 | 1/1975 | Langdon | 211/59.2 X |
| 4,155,457 | 5/1979 | Wilbert | 211/13 X |
| 4,322,007 | 3/1982 | Feibelman | 211/13 X |
| 4,391,375 | 7/1983 | Joyce | 211/13 |
| 4,442,942 | 4/1984 | Cuminale et al. | 211/163 |
| 4,664,264 | 5/1987 | Kirk | 211/13 |

*Primary Examiner*—Robert W. Gibson, Jr.
*Attorney, Agent, or Firm*—Spensley Horn Jubas & Lubitz

[57] ABSTRACT

An improved gravity feed display system and display card for the display of jewelry articles and the like. The gravity feed display system comprises pairs of inclined slots spaced apart to slidably receive the display cards in such manner that when a lower card is pulled out, a card situated adjacently above slides down to occupy the position of the card being removed. Each display card comprises a generally flat panel and a top flange, and means to prevent the overlapping of an adjacent card while in the display system.

10 Claims, 2 Drawing Sheets

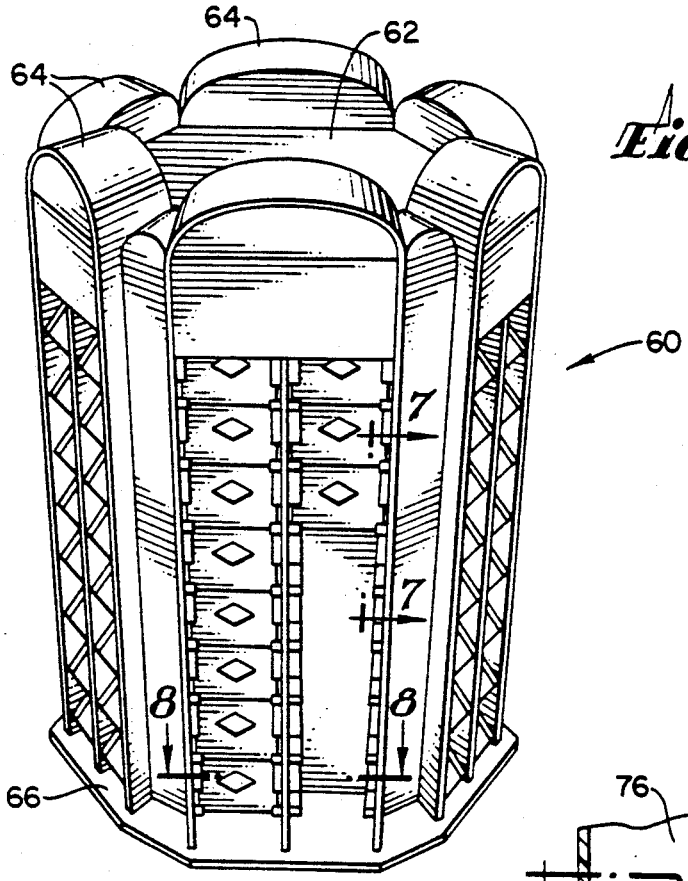
Fig. 6
Fig. 7
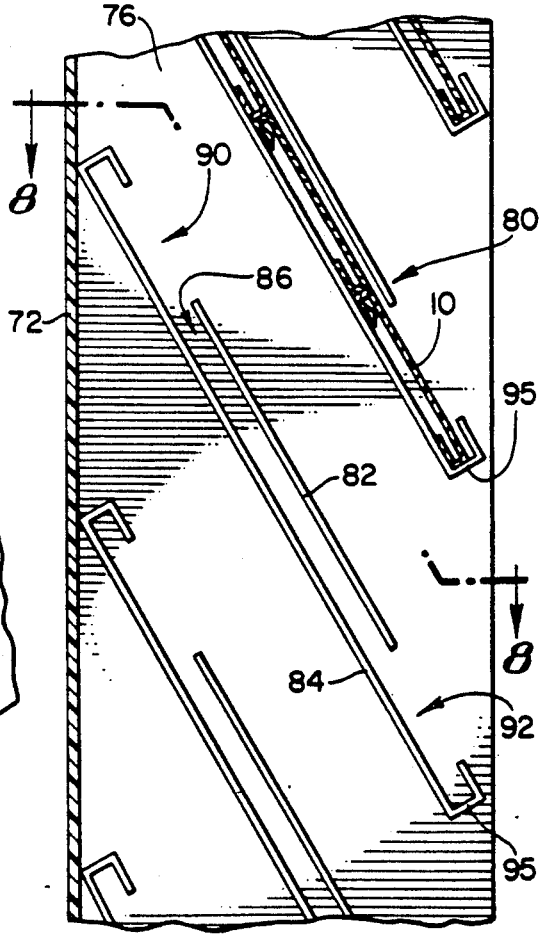
Fig. 8
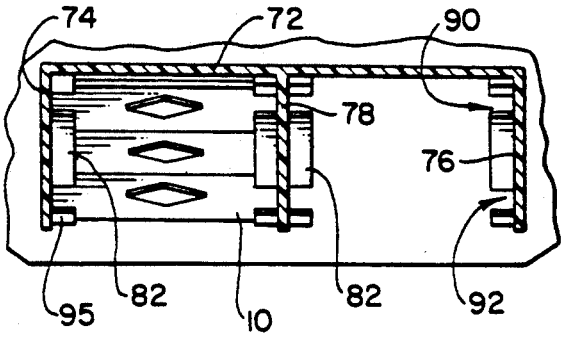

GRAVITY FEED JEWELRY DISPLAY SYSTEM AND DUAL-FLANGE DISPLAY CARD

BACKGROUND OF THE INVENTION

1. Field of the Invention

This invention pertains to display devices in general, and in particular, to a gravity feed system and a display device adapted for displaying jewelry articles such as earrings and the like.

2. Description of the Related Art

A common way of supporting earrings and other jewelry for display is to attach them to the front face of a flat panel. The panel can be provided with a rearwardly extending flange or clip portion such that the panel may be supported from a display rod or the like in a generally vertical position. The posts of the earrings extend through openings provided in the panel and are retained by the clasp mechanisms provided therewith. In such constructions, it is also common to provide the area of the panel to which the jewelry articles are attached with decoration including attachment thereto of a decorative element, such as a felt pad, or by providing a flocked coating in such area.

It is also common that the panels or display cards are hung in display cases or racks one in front of the other so that the customer can view only the front card and its contents. This necessitates that the customer remove the front card in order to view the jewelry contained on the next display card.

Gravity feed display racks are generally known in the prior art. For instance, U.S. Pat. No. 3,957,174 to Palamara discloses a vertically mounted storage and dispenser unit for small boxes. The unit consists of a main channel divided by ledges into several sub-channels having bottom stops to hold the boxes therein. The boxes slide into the sub-channels from the top and the unit can be made to hold a large number of boxes. The leading edges of the ledges are staggered with respect openings for the lateral removal of the boxes from the sub-channels.

Similarly, U.S. Pat. No. 2,147,086 to Bryan discloses a display stand for boxes. The stand comprises a sheet of metal stamped to form pairs of parallel flanges at right angles to the sheet. A shelf is stamped from the sheet below each pair of flanges at a distance slightly less than the width of the boxes to be displayed. The shelf prevents the boxes from sliding out of the flanges yet allows them to be readily dispensed.

As noted above, earring display cards are also known in the art. U.S. Pat. No. 4,281,469 to Feibelman discloses an earring display card. One feature is a removable identification panel which allows the advertising label to be easily changed instead of changing the particular jewelry attached to the card.

Similarly, U.S. Pat. No. 4,099,611, also to Feibelman, discloses a display card having an anti-theft feature. A detachable portion of the display card, whereon the jewelry is attached, appears to the casual observer to be securely fastened when in reality it is easily removed.

Although these display cards and other similar prior devices all represent contributions to the art, none are particularly suitable for use in a gravity feed display for at least the following reasons: those display cards having only a single flange or clip portion tend to overlap when placed on display in a gravity feed display rack; the overlapping of display cards reduces the available surface area on which to place indicia of advertising; the overlapping also creates a cluttered, unaesthetic appearance in the display that may confuse potential customers.

It is therefore an object of the present to provide a display card and gravity feed display system for jewelry articles such as earrings and the like.

Yet another object of the present invention is to provide a display card and gravity feed display system which allows the indicia of advertising to be more readily seen by customers.

It is another object of the present invention to provide a display card and gravity feed display system that produces an aesthetic, uncluttered appearance that does not confuse customers.

It is yet another object of the present invention to provide a display card that is easier to manufacture due to its symmetry.

Other objects and features of the invention will become apparent from consideration of the following detailed description taken in connection with the accompanying drawings.

SUMMARY OF THE INVENTION

These objects, and others, are achieved by an improved gravity feed display system and display card for the display of jewelry articles and the like. The gravity feed display system comprising pairs of inclined slots spaced apart to slidably receive the display cards in such manner that when a lower card is pulled out, a card situated above slides down to occupy the position of the card being removed.

Each display card comprises a generally flat panel and a top flange. The cards have means to prevent the overlapping of an adjacent card while on display in the display system.

A better understanding of the invention, its uses and its other objects and advantages, may be obtained from a consideration of the following detailed description of the preferred embodiments, particularly when read in conjunction with the appended drawings, a brief description of which now follows.

BRIEF DESCRIPTION OF THE DRAWINGS

FIG. 6 is a perspective view of the display rack of the gravity feed display system of the present invention.

FIG. 7 is a sectional plan view of the display rack taken along line 7—7 of FIG. 6.

FIG. 8 is a top sectional plan view of a compartment of the display rack taken along line 8—8 of FIG. 6.

DETAILED DESCRIPTION OF THE PREFERRED EMBODIMENT

Figure 1:
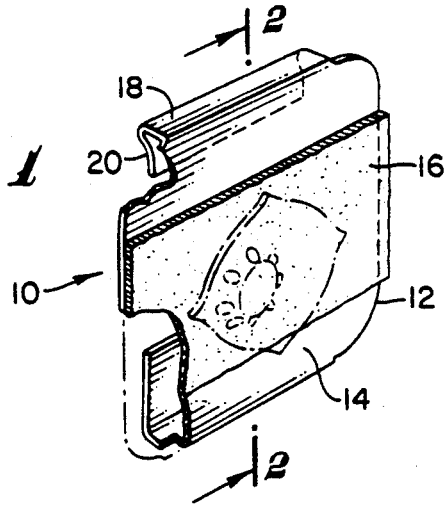
FIG. 1 is a perspective view of the dual-flange earring display card of the present invention.
Figure 2:
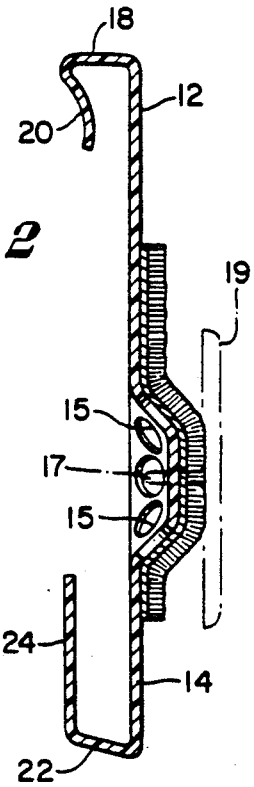
FIG. 2 is a side sectional view of the dual-flange earring display card taken along the line 2—2 of FIG. 1.
Figure 3:
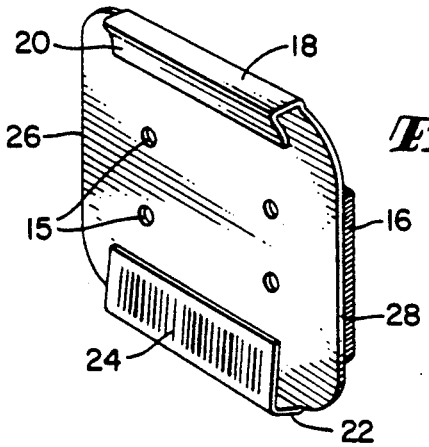
FIG. 3 is a perspective view of the rear of the earring display card having an enlarged bottom flange.

Referring to the drawings and in particular FIGS. 1-3, a preferred embodiment of the display card 10 of the present invention is shown. Such card includes a panel 12 of a generally planar configuration and having a front face 14 on which a decorative flocked pad 16 is attached as by adhesive connection. That portion of the panel 12 underlying the pad 16 is conventionally provided with openings 15 therethrough for receipt of the shaft portion 17 of a post type-earring 19. As is known, the post of the earring is inserted through the openings 15 and clamped on the opposite side of the panel 12 by a conventional clasp retention member. In this manner the earring is mounted for point-of-sale display on the card 10.

Prior to the invention of the present system, a plurality of such cards 10 were displayed by suspension on rods or the like provided in a display case or rack (not shown). Such suspension means consisted of a top flange 18 which extended rearwardly from the top edge of the panel 12 and terminated in a downwardly extending portion 20 so as to form a generally U-shaped configuration such that card 10 could be supported upon a display rod in a generally vertical position.

Figure 4:
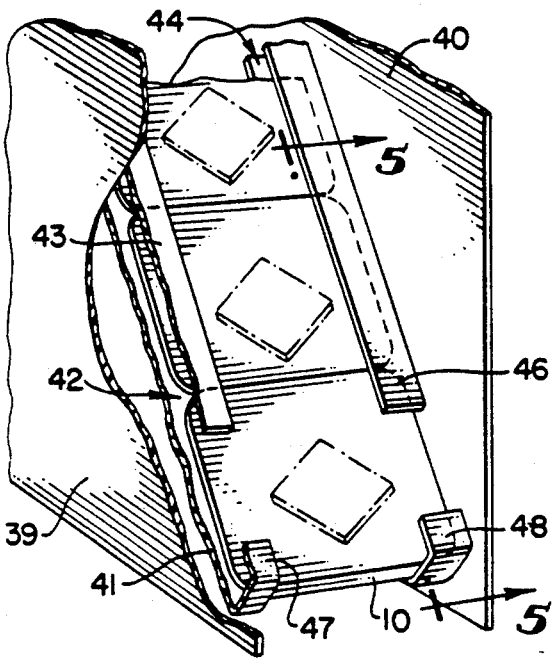
FIG. 4 shows the gravity feed display system with the dual-flange earring display cards in place.

The display card of the present invention, however, includes not only top flange 18, but also a bottom flange 22 which extends rearwardly from the bottom edge of the panel 12 and terminates in an upwardly extending portion 24, forming a second U-shaped configuration. As shown in FIG. 3, the dimensions of portion 24 can be adapted to accommodate a table bar code label which can be scanned for inventory and transactional purposes. Side edges 26 and 28 extend laterally beyond the top and bottom flanges 18 and 22, respectively, and allow the card 10 to be easily inserted into inclined opposing slots 42 and 44 as shown in FIG. 4. Collectively, the display card 10 having top flange 18 and bottom flange 22, together with opposing slots 42 and 44 make up the gravity feed jewelry display system.

Figure 5:
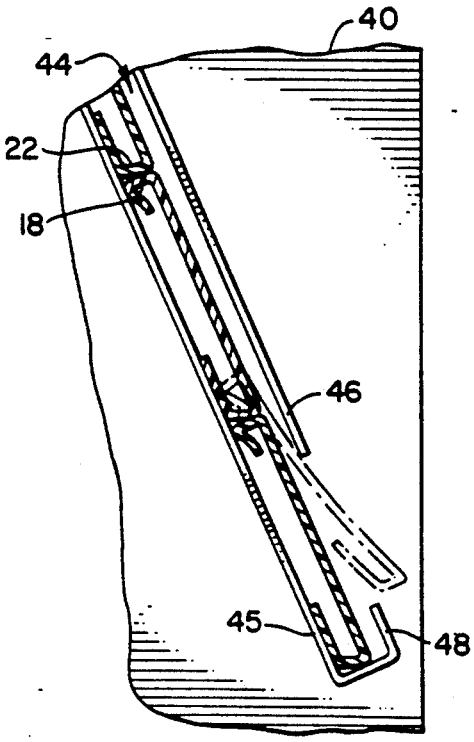
FIG. 5 is a side sectional view taken along line 5—5 of FIG. 4 of the gravity feed system with the dual-flange earring display cards in place.

As shown in FIG. 5, slot 44 is formed by lower and upper ledges 45 and 46, respectively, disposed on opposing wall 40 of the gravity feed system. Slot 42 is formed in the same manner by lower and upper ledges 41 and 43, respectively, disposed on opposing wall 39. L-shaped feet, 47 and 48, are disposed on the lower ends of the lower ledges, 41 and 45, respectively, to keep the display card 10 from sliding out of the opposing slots, 42 and 44.

As is also shown in FIG. 5, bottom flange 22 of one display card 10, butts against top flange 18 of the next lower display card 10, thereby preventing the cards from overlapping while on display in the gravity feed system.

FIG. 6 shows another embodiment of the gravity feed jewelry display system. A display rack 60 is shown having a core 62 adapted to receive a plurality of compartments 64. The core 62 has a base 66 including a bearing (not shown) which allows the display rack 60 to be rotated. Each compartment 64 has a back wall 72, side walls 74 and 76, and a middle wall 78 which bisects the compartment 64 from top to bottom along the midline of back wall 72, as shown if FIG. 8. The plane of the middle wall 78 is parallel to the planes of side walls 74 and 76. Thus, one face of the middle wall 78 opposes side wall 74, while the other face of middle wall 78 opposes side wall 76.

As shown in FIGS. 7 and 8, pairs of inclined ledges 80, including upper ledge 82 and lower ledge 84, extend inwardly from the inside faces of both side walls 74 and 76, and from both faces of middle wall 78. Upper and lower ledges 82 and 84 are spaced apart approximately ⅛ of an inch and are parallel to each other to form slot 86. Upper ledge 82 is shorter than lower ledge 84 and it is centered above lower ledge 84 to create upper and lower openings 90 and 92. These openings 90 and 92 facilitate the insertion and removal of display cards 10. The pairs of ledges 80, extending from the inside faces of side walls 74 and 76, directly oppose pairs of ledges 80, extending from the corresponding opposing face of the middle wall 78. In this manner, slots 86 formed on side wall 74 directly oppose slots 86 formed on the left face of middle wall 78. Likewise, slots 86 formed on side wall 76 directly oppose slots formed on the right face of middle wall 78. An L-shaped foot 95 is attached to the lower end of each lower ledge 84 to prevent the display cards 10 from sliding out of the pairs of opposing slots 88.

The display cards 10 preferably are extruded out of a plastic material which remains flexible after molding. The display rack is preferably made from a more rigid plastic or other suitable material.

While there have been shown and described preferred embodiments in accordance with the invention, it will be appreciated that many changes and modifications may be made therein without departing from the spirit of the invention.

What is claimed is:

1. An improved gravity feed display system for the mounting and display of display cards, the system comprising:

a pair of inclined slots spaced apart to slidably receive said cards in such manner that when a lower card is pulled out, a card situated above slides down to occupy the position of the card being removed, each card comprising:

a generally flat panel and a top flange, and means to prevent the overlapping of an adjacent card while on display in the display system.

2. The system of claim 1, wherein said preventing means comprises a bottom flange extending from said panel and terminating in an upwardly extending portion to form a generally U-shaped configuration.

3. The system of claim 2, wherein said panel has first and second sides which extend outwardly beyond said top and bottom flanges.

4. A system for the display of jewelry articles and the like comprising:

(a) a generally elongated display rack having vertical opposing spaced apart walls, said walls including inclining slots adapted to receive display cards, and consisting of upper and lower ledges, said ledges having lower and upper ends, and said lower ledges including means for blocking to keep said display cards from sliding out of said slots;

(b) a plurality of display cards, each card consisting of a flexible panel having a top edge, a bottom edge, first and second sides and a generally planar face, said face having means for receiving at least a portion of an article of jewelry; and (c) means attached to each of said display cards for preventing the overlapping of said display cards while within said inclining slots of said display rack.

5. The system of claim 4, wherein said blocking means comprises L-shaped feet disposed on said lower ends of said lower ledges.

6. The system of claim 5, wherein said preventing means comprises:

a top flange rearwardly extending from the top edge of said panel and terminating in a downwardly extending portion so as to form a first, generally U-shaped configuration; and a bottom flange rearwardly extending from said bottom edge of said panel and terminating in an upwardly extending portion to form a second, generally U-shaped configuration.

7. The system of claim 6, wherein said first and second sides of said panel extend outwardly beyond said top and bottom flanges.

8. A card for the display of jewelry articles and the like comprising:

(a) a flexible panel having a top edge, a bottom edge, first and second sides, and a generally planar face including a display area having means to receive at least a portion of a jewelry article displayed thereon;

(b) a top flange rearwardly extending from the top edge of said panel and terminating in a downwardly extending portion so as to form a first, generally U-shaped configuration; and (c) a bottom flange rearwardly extending from said bottom edge of said panel and terminating in an upwardly extending portion to form a second, generally U-shaped configurations;

wherein said first and second sides of said panel extend outwardly beyond said top and bottom flanges.

9. A system for the display of jewelry articles and the like on display cards, the system comprising:

(a) a display rack including a plurality of compartments, each compartment having a back wall, a pair of side walls secured to the edges of said back wall to define a channel within said compartment, a middle wall having two faces and extending outwardly from the middle of said back wall dividing said channel into two sub-channels, a series of inclined ledges secured to and projecting inwardly from said side walls and also from both faces of said middle wall to form inclined, opposing slots within each sub-channel for accommodating display cards, said series of ledges consisting of a lower ledge having an L-shaped foot disposed on a low end of said lower ledge to prevent said display cards from sliding out, and a short upper ledge centered above said lower ledge to form top and bottom openings for the insertion and removal of said display cards;

(b) a plurality of display cards disposed on said rack, each display card comprising a flexible panel having a top edge, a bottom edge, first side and second sides, and a generally planar face including a display area having means to receive at least a portion of a jewelry article displayed thereon, said display card further having means for preventing the overlapping of adjacent display cards while on display within said slots of said display rack.

10. The system of claim 9, wherein said preventing means comprises:

a top flange rearwardly extending from the top edge of said panel and terminating in a downwardly extending portion so as to form a first, generally U-shaped configuration; and a bottom flange rearwardly extending from the bottom edge of said panel and terminating in an upwardly extending portion to form a second, generally U-shaped configuration.

* * * * *